US008336982B2

(12) United States Patent
Vall et al.

(10) Patent No.: US 8,336,982 B2
(45) Date of Patent: Dec. 25, 2012

(54) FLUID EJECTION PRINTING WITH AUTOMATIC PRINT MODE SWITCHING

(75) Inventors: Marc Serra Vall, Barcelona (ES); Angel Martinez-Barambio, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 224 days.

(21) Appl. No.: 12/836,110

(22) Filed: Jul. 14, 2010

(65) Prior Publication Data

US 2012/0013665 A1 Jan. 19, 2012

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS 6,142,605 A 11/2000 Serra et al.
6,250,739 B1 6/2001 Serra
6,254,217 B1 7/2001 Askeland et al.
6,273,549 B1 8/2001 Wetchler et al.
6,565,192 B1 5/2003 Vinals et al.
6,595,612 B1 7/2003 Brown et al.
6,938,977 B2 9/2005 Corbin et al.
7,054,034 B2 5/2006 Underwood et al.
7,152,947 B2 12/2006 Wu
2003/0202045 A1* 10/2003 Torgerson et al. ..... 347/43
2006/0203061 A1* 9/2006 Ichinose et al. ..... 347/100
2008/0266343 A1 10/2008 Borrell et al.
2008/0309959 A1 12/2008 Martinez et al.
2009/0135217 A1* 5/2009 Cardells et al. ..... 347/9

* cited by examiner

*Primary Examiner* — Laura Martin

(57) ABSTRACT

A method of printing a document using a fluid-ejection printing device includes receiving gray scale image data for the document, and identifying at least one area fill feature of the image data. It is determined whether the at least one area fill feature will be printed with a combination of different black inks and is likely to produce a visible image defect if printed in an N-pass bidirectional print mode, where N is an integer. Non-fill regions of the image data are printed using the N-pass bidirectional print mode. The method further includes automatically switching to an M-pass bidirectional print mode for printing the at least one area fill feature when it is determined that the at least one area fill feature will be printed with a combination of different black inks and is likely to produce a visible image defect, where M is an integer greater than N.

20 Claims, 3 Drawing Sheets

FLUID EJECTION PRINTING WITH AUTOMATIC PRINT MODE SWITCHING

BACKGROUND

Inkjet printers generally incorporate multiple printheads in a scanning carriage which scans left-to-right and right-to-left across a medium while the printheads eject droplets of ink. The printheads are typically housed in one or more print cartridges either containing ink or having ink supplied to them from an external source. The ink is channeled to ink ejection chambers formed on a substrate associated with each printhead. Within each of the ink ejection chambers is an ink ejection element, such as a resistive heater or a piezoelectric element. A nozzle plate resides over each printhead such that each nozzle is aligned over an ink ejection chamber. Each printhead may have hundreds of nozzles for printing at 300 dots per inch or more. As energization signals are provided to the ink ejection elements as the printheads are scanned across the medium, ink droplets are ejected from the nozzles to create a pattern of ink dots to print text or an image.

Inkjet printing devices may include several print modes. In a unidirectional print mode, a printhead of the printing device prints just when it is moving in a given direction past the media in question, such as a sheet of paper. For example, the printhead may print just when it moves from left to right, and not when it moves from right to left. By comparison, in a bidirectional print mode, a printhead of the printing device prints when it is moving in either direction past the media. For example, the printhead may print both when it moves from left to right, as well as when it moves from right to left.

Bidirectional print modes include a one-pass bidirectional print mode and a multi-pass bidirectional print mode. A one-pass mode is one in which a pen or printhead passes a single time over a horizontal band of the print medium, and then the print medium is typically advanced by a distance that corresponds to the printhead height. A multi-pass mode is one in which a pen or printhead passes more than once over a horizontal band of the print medium. In each pass, the printhead deposits a swath having only a fraction of the total ink used in each section of the image, with areas being left unprinted to be filled in during one or more other passes. For each pass in multi-pass printing, the print medium is typically advanced by a distance that corresponds to the printhead height divided by the number of passes to be undertaken.

One-pass bidirectional print modes typically provide the best printing speed. These print modes, however, can produce image quality defects when printing area fills. One image quality defect in one-pass bidirectional print modes when printing medium or dark gray area fills is called gray scale shift banding or darkness shift banding, which shows up as a change in gray scale level in consecutive passes. Gray scale shift banding is typically very visible in dark gray area fills when printing in one-pass bidirectional print modes.

In one-pass bidirectional print modes, since the arrangement of the printheads in the scanning carriage is fixed, ink drops typically fall in a different sequence when the carriage is moving from left-to-right than when moving from right-to-left. For example, to create a dark gray color, some printers will use a combination of photo black ink drops and matte black ink drops. When the carriage moves from left-to-right, the matte black dots fall on top of the photo back dots. When the carriage moves from right-to-left, ink drops fall in the inverse sequence. Water in ink drops is immediately absorbed by the media and, therefore, the colorant is laid on the surface instantaneously. When matte black drops fall on top of the photo black drops, there is no time for the colorants to mix properly. In this way, matte black colorant will lay on top of the photo black when printing from left to right and vice versa when printing in the opposite direction. This results in gray scale shift in consecutive passes when printing some gray area fills.

SUMMARY

One embodiment is directed to a method of printing a document using a fluid-ejection printing device. The method includes receiving gray scale image data for the document, and identifying at least one area fill feature of the image data. It is determined whether the at least one area fill feature will be printed with a combination of different black inks and is likely to produce a visible image defect if printed in an N-pass bidirectional print mode, where N is an integer. Non-fill regions of the image data are printed using the N-pass bidirectional print mode. The method further includes automatically switching to an M-pass bidirectional print mode for printing the at least one area fill feature when it is determined that the at least one area fill feature will be printed with a combination of different black inks and is likely to produce a visible image defect, where M is an integer greater than N.

Another embodiment is directed to a fluid-ejection printing device, which includes a fluid-ejection printing mechanism configured to eject droplets of fluid on media in correspondence with image data. The printing device includes a data processing mechanism configured to identify at least one area fill feature of the image data that will be printed with a combination of different black inks and that is likely to produce a visible image defect if printed in a one-pass bidirectional print mode. The fluid-ejection printing mechanism is configured to print non-fill regions of the image data using the one-pass bidirectional print mode, and is configured to automatically switch to a multi-pass bidirectional print mode for printing the at least one area fill feature.

Yet another embodiment is directed to a printing system, which includes a fluid-ejection printing mechanism configured to eject droplets of fluid on media in correspondence with image data. The printing system includes a controller configured to identify at least one area fill feature of the image data that will be printed with a combination of different black inks and that is likely to produce a visible image defect if printed in a one-pass bidirectional print mode. The controller is configured to cause the fluid-ejection printing mechanism to print non-fill regions of the image data using the one-pass bidirectional print mode and automatically switch to a multi-pass bidirectional print mode for printing the identified at least one area fill feature.

DETAILED DESCRIPTION

Some embodiments are directed to systems and methods for printing documents using printing modes that are automatically selected based on a content analysis of print data. The print data may correspond to printed images that are text, graphics, photographs, or portions or combinations thereof, among others. As described above, printing area fills with a one-pass bidirectional print mode can cause gray scale shift banding. There is a variable that modulates the severity of the gray scale shift, which is area fill ink density. For light gray area fills (i.e., lower black ink density), gray scale shift is typically not visible to the human eye. On the other hand, gray scale shift becomes more severe in dark gray area fills (i.e., higher black ink density). It is for these reasons that, when printing medium or dark gray area fills with one-pass bidirectional print modes, the image quality is typically not acceptable. Embodiments of the systems and methods described herein print bidirectionally in a one-pass mode or a multi-pass mode according to the content of the print data. In one embodiment, a multi-pass mode is automatically selected on the fly (e.g., during printing of a document) for area fill features of the document that are to be printed with a combination of different black inks and that are likely to produce a visible image defect if printed in the one-pass mode.

Figure 1:
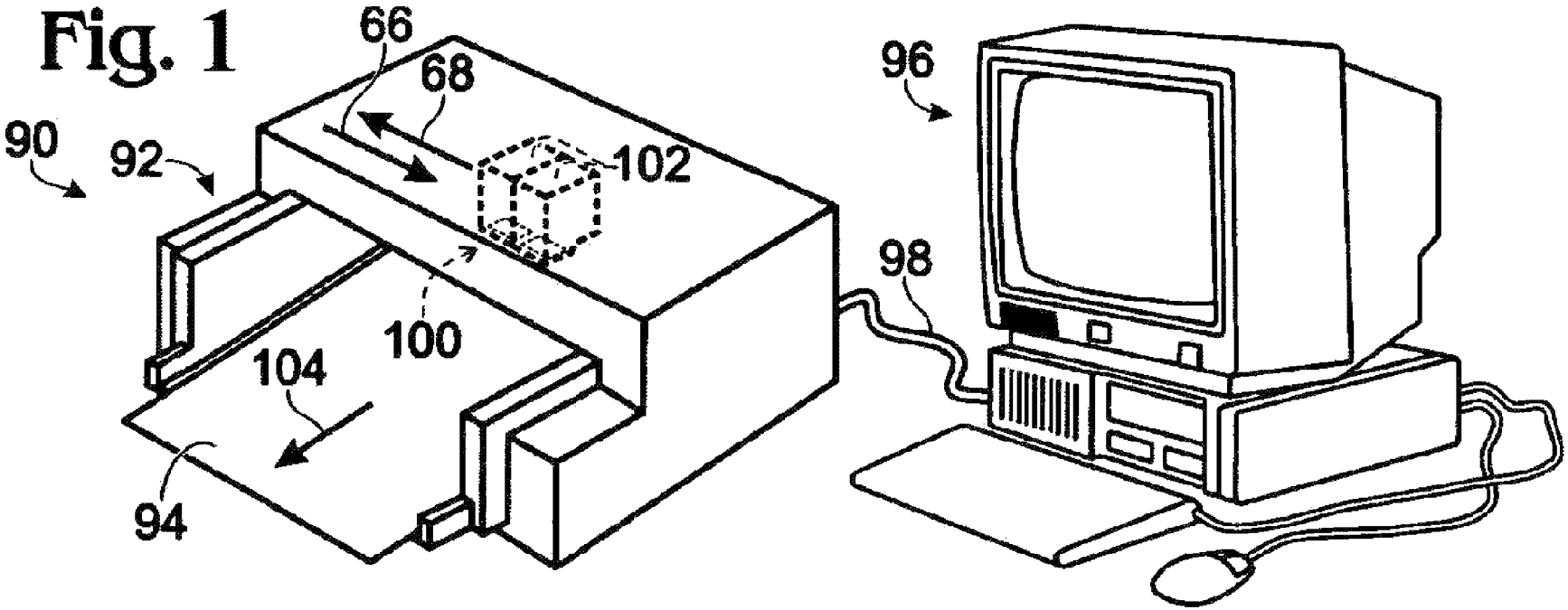
FIG. 1 is a diagram illustrating a printing system according to one embodiment.

FIG. 1 is a diagram illustrating a printing system 90 according to one embodiment. System 90 includes a printer 92 configured to print images onto a print medium 94, and a computing device 96 in communication with the printer 92 via a communication link 98. Computing device 96 is configured to send image data or print data in any suitable form to the printer 92. Printer 92 according to one embodiment is a fluid-ejection printing device that includes a fluid-ejection printing mechanism configured to eject droplets of fluid on media in correspondence with image data.

Printer 92 includes at least one printhead 100. In the illustrated embodiment, printhead 100 is an assembly of printheads including a plurality of ink cartridges 102. In one embodiment, the at least one printhead 100 is a scanning printhead that is configured to move relative to print medium 94. In the illustrated embodiment, the at least one printhead 100 is configured to scan bidirectionally in directions 66 and 68 along an x-axis defined by the printer 92. The printer 92 is configured to move the print medium 94 along a y-axis 104 disposed orthogonally to the scan or x-axis of the printer 92.

In one embodiment, printer 92 is configured to selectively operate in a one-pass bidirectional print mode and a multi-pass bidirectional print mode. In the single-pass bidirectional print mode according to one embodiment, after each printing pass, the media is advanced a distance equal to the printhead swath height, such that each pass forms on the media a complete strip of the image. In the multi-pass bidirectional print mode according to one embodiment, the media is advanced only a fraction of the printhead swath height after each printing pass, and only a fraction of the ink dots used to form a strip of the image is laid down in each printing pass, such that areas left unprinted in one pass are filled in during one or more subsequent passes. The final image is thus formed in a number of consecutive and partly overlapping passes.

Figure 2:
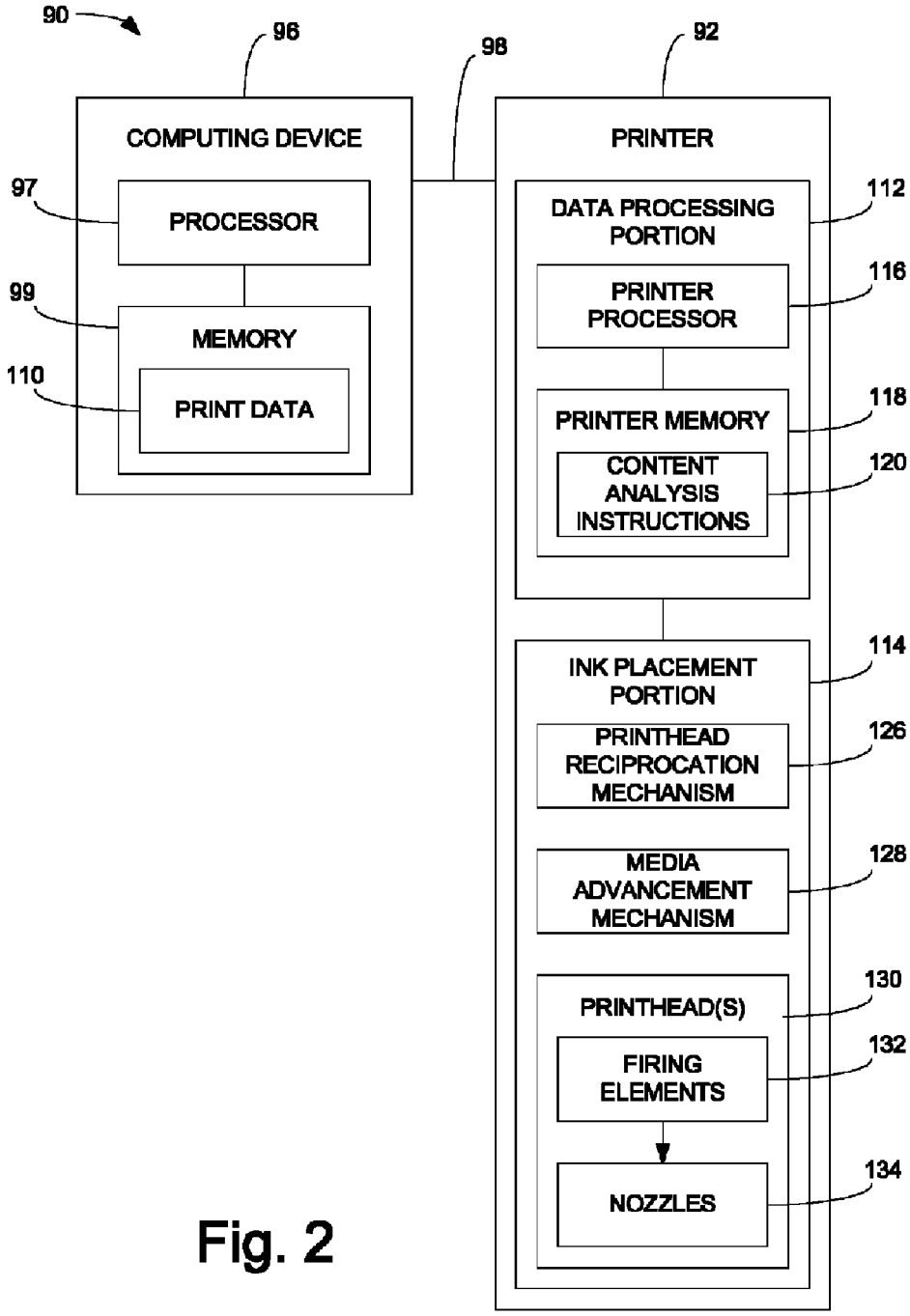
FIG. 2 is a block diagram illustrating elements of the printing system shown in FIG. 1 according to one embodiment.

FIG. 2 is a block diagram illustrating elements of the printing system 90 shown in FIG. 1 according to one embodiment. Computing device 96 includes processor 97 and memory 99. Image data or print data 110 is stored in memory 99. Computing device 96 is configured to send print data 110 to printer 92 via communication link 98. In the illustrated embodiment, printer 92 is configured to perform a content analysis of the print data and automatically select printing modes based on the analysis, as well as perform other functions. However, in other embodiments, computing device 96 may perform some or all of these functions, either alone or in combination with printer 92.

Printer 92 includes a data processing portion 112 and an ink placement portion 114. The data processing portion 112 and the ink placement portion 114 may each be implemented in hardware, software, or a combination of hardware and software. Data processing portion 112 is configured to receive print data 110 from computing device 96 and process the print data 110 into printing instructions for the ink placement portion 114. As part of this processing according to one embodiment, data processing portion 112 performs a content analysis of the print data 110 and selects print modes for printing the print data 110. Ink placement portion 114 is configured to positionally dispense ink to a print medium using the modes selected by the data processing portion 112.

In one embodiment, data processing portion 112 is configured to identify at least one area fill feature of the print data that will be printed with a combination of different black inks and that is likely to produce a visible image defect if printed in a one-pass bidirectional print mode, and the ink placement portion 114 is configured to print non-fill regions of the print data using the one-pass bidirectional print mode, and is configured to automatically switch to a multi-pass bidirectional print mode for printing the at least one area fill feature. The ink placement portion 114 is configured to automatically switch back to the one-pass bidirectional print mode after printing the at least one area fill feature. The data processing portion 112 is configured in one embodiment to cause the ink placement portion 114 to switch print modes in the above-described manner. The at least one area fill feature according to one embodiment represents a plurality of contiguous pixels that all have a common gray scale value.

In one embodiment, the data processing portion 112 is configured to identify whether an ink density of the at least one area fill feature is greater than a minimum threshold density at which gray scale shift banding becomes visible to the human eye. In one embodiment, the minimum threshold density is about 70%. In another embodiment, the minimum threshold density is about 85%. In one embodiment, the data processing portion 112 is also configured to identify whether the ink density of the at least one area fill feature is less than a maximum threshold density at which only a single black ink is used to print the at least one area fill feature. The maximum threshold density according to one embodiment is about 99%.

The specific elements of data processing portion 112 and ink placement portion 114 according to one embodiment will now be described in further detail. Data processing portion 112 includes a printer processor 116 and printer memory 118. The printer processor 116 is configured to perform processing of data received from the computing device 96 and from the printer memory 118, including logic and arithmetic operations, among others. Such data may include the print data 110 and processing instructions for the print data. Printer memory 118 includes content analysis instructions 120. The content analysis instructions 120 are configured to cause the printer processor 116 to determine one or more values from the print data 110 and compare those values with at least one predefined threshold (or threshold value) to automatically select one or more printing modes.

Ink placement portion 114 includes a printhead reciprocation mechanism 126, a media advancement mechanism 128, and at least one printhead 130. Printhead reciprocation mechanism 126 is configured in one embodiment to scan the at least one printhead 130 bidirectionally, as shown in FIG. 1. Media advancement mechanism 128 moves print media along an axis orthogonal to the axis defined by the movement of the printhead reciprocation mechanism 126. In some embodiments, the printhead reciprocation mechanism 126 may perform the function of the media advancement mechanism 128 by moving orthogonally. The at least one printhead 130 includes firing elements 132, such as heater elements or piezoelectric elements. The firing elements 132 operate to expel ink droplets from nozzles 134 onto print media.

The printer 92 may be a printing device that has just printing functionality, or a multi-function device (MFD) or an all-in-one (AIO) device that has printing functionality as well as other functionality like scanning and/or faxing functionality, or another type of printing device. In one embodiment, printer 92 uses a plurality of different black inks (e.g., matte black ink and photo black ink) and is configured to print exclusively in grayscale (i.e., a "monochrome" printer). In another embodiment, printer 92 uses a plurality of different blank inks for printing in grayscale, and also includes a plurality of different colored inks for color printing. Those of ordinary skill in the art will appreciate that the printer 92 may have other mechanisms and/or components, in addition to those shown in FIGS. 1 and 2.

In one embodiment, printer processor 116 is configured to automatically increase the number of passes in a one-pass bidirectional print mode to two or more passes when a medium gray or dark gray area fill feature is detected by printer processor 116, which reduces or eliminates gray scale shift in these area fills. An area fill feature according to one embodiment defines a solid region, which itself is defined as more than one contiguous pixel having the same gray scale level but that does not define a line. Multi-pass bidirectional print modes usually eliminate gray scale shift because ink drops fall on the media in a more similar sequence. In one embodiment, once the area fill is printed, printer processor 116 automatically switches the print mode from the multi-pass bidirectional print mode back to a one-pass bidirectional print mode to minimize printing speed loss. In one embodiment, printer processor 116 performs a density analysis function on print data 110 to detect high black ink density area fills in the following pass to the one being printed. If the black ink density in the following swath exceeds a predefined minimum threshold, the printer 92 is automatically switched to a multi-pass bidirectional mode.

A number of characterization tests have been performed using a black ink set for a monochrome printer. The monochrome printer used a matte black ink and a photo black ink. For lighter gray regions (e.g., regions with black ink densities of less than about 45%), the printer only used the photo black ink. For medium and dark gray regions (e.g., regions with black ink densities of between about 45% to 99%), the printer used a combination of photo black ink and matte black ink. For regions with black ink densities of 99% or higher, the printer only used the matte black ink. It has been determined from these characterization tests that the minimum black ink density (darkness) needed to start seeing gray scale shift is about 70%. Gray scale shift does not occur in regions where only a single black ink is used. In one embodiment, whenever an area fill with a black ink density in the range of about 70% to 99% is detected by printer processor 116 when printing in a one-pass bidirectional print mode, a multi-pass bidirectional mutant print mode is triggered by printer processor 116 to avoid gray scale shift. In another embodiment, the multi-pass mutant print mode is triggered for area fills with black ink densities in the range of about 85% to 99%. The specific thresholds may vary based on the properties of the different black inks that are used, as well as the properties of the print media.

In one embodiment, the multi-pass mutant print mode is not triggered for light gray area fills or medium gray area fills, but only for dark gray area fills. In one embodiment, the multi-pass mutant print mode is also not triggered in 100% black ink density area fills, because in these cases, only matte black ink is used and therefore, no gray scale shift appears. For lower black ink densities, photo black ink is used in combination with matte black ink to improve gray transitions and minimize grain.

Figure 3:
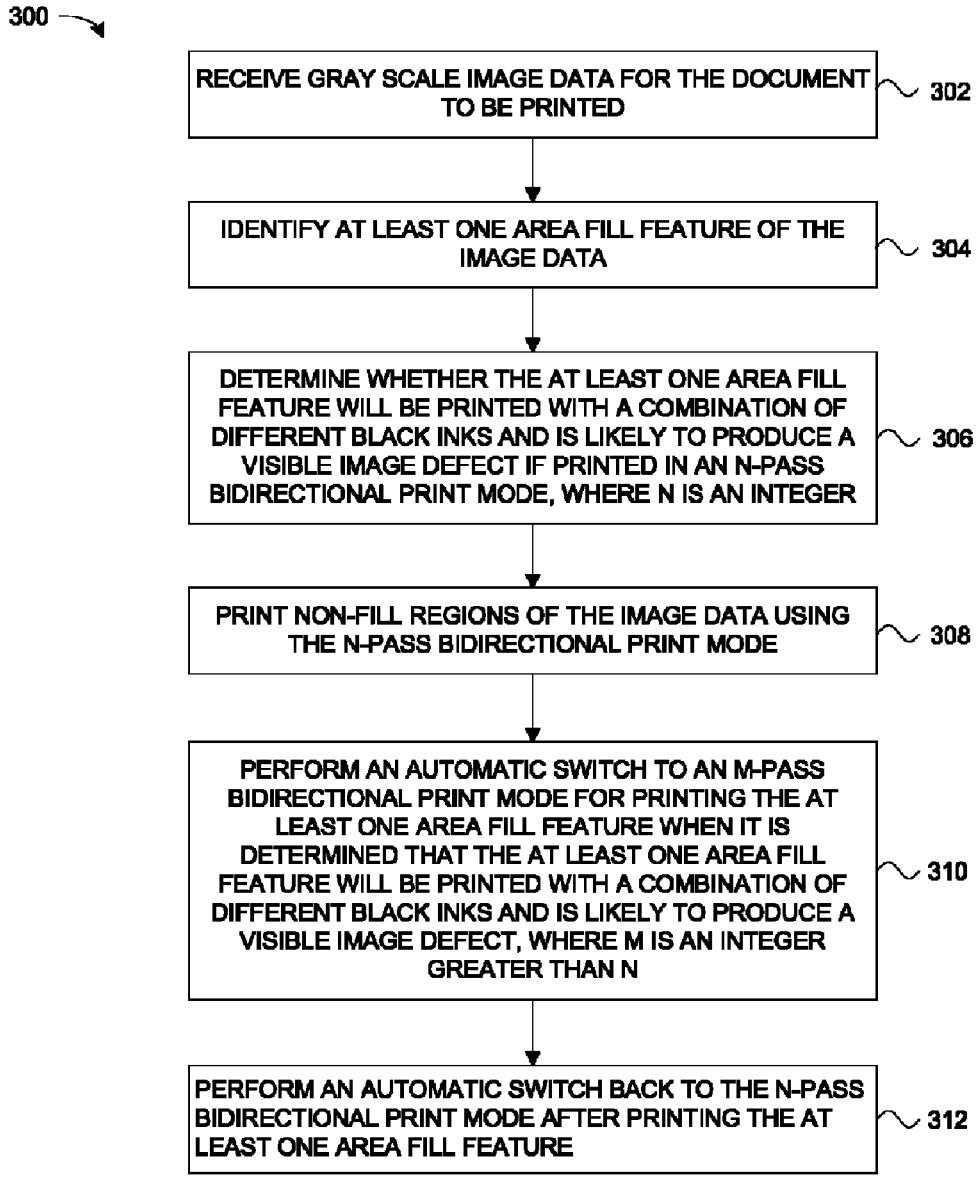
FIG. 3 is a flow diagram illustrating a method of printing a document using a fluid-ejection printing device according to one embodiment.

FIG. 3 is a flow diagram illustrating a method 300 of printing a document using a fluid-ejection printing device according to one embodiment. In one embodiment, printing system 90 (FIGS. 1 and 2) is configured to perform method 300. At 302 in method 300, gray scale image data for the document to be printed is received. At 304, at least one area fill feature of the image data is identified. At 306, it is determined whether the at least one area fill feature will be printed with a combination of different black inks and is likely to produce a visible image defect if printed in an N-pass bidirectional print mode, where N is an integer. At 308, non-fill regions of the image data are printed using the N-pass bidirectional print mode. At 310, an automatic switch to an M-pass bidirectional print mode is performed for printing the at least one area fill feature when it is determined that the at least one area fill feature will be printed with a combination of different black inks and is likely to produce a visible image defect, where M is an integer greater than N. At 312, an automatic switch back to the N-pass bidirectional print mode is performed after printing the at least one area fill feature.

In one embodiment of method 300, the at least one area fill feature identified at 304 represents a plurality of contiguous pixels that all have a common gray scale value. In one embodiment, N is one and M is two in method 300. The determination at 306 according to one embodiment involves identifying whether an ink density of the at least one area fill feature is greater than a minimum threshold density at which gray scale shift banding becomes visible to the human eye. In one embodiment, the minimum threshold density is about 70%. In another embodiment, the minimum threshold density is about 85%. The determination at 306 according to one embodiment further involves identifying whether the ink density of the at least one area fill feature is less than a maximum threshold density at which only a single black ink is used to print the at least one area fill feature. In one embodiment, the maximum threshold density is about 99%. In one embodiment, the fluid-ejection printing device of method 300 is a monochrome inkjet printing device that is configured to exclusively print with black inks.

The method 300 may be implemented as one or more computer programs stored on a computer-readable medium, such as a recordable data storage medium. The computer-readable medium may be inserted into or may be a part of the fluid-ejection printing device itself, such that the computer programs are executed by the printing device. Alternatively, the computer-readable medium may be inserted into or may be a part of a host computing device to which the fluid-ejecting printing device is communicatively connected, such that the computer programs are executed by the host computing device.

Although the present disclosure has been described with reference to preferred embodiments, workers skilled in the art will recognize that changes can be made in form and detail without departing from the spirit and scope of the present disclosure.

What is claimed is:

1. A method of printing a document using a fluid-ejection printing device, the method comprising:

receiving gray scale image data for the document;

identifying at least one area fill feature of the image data;

determining whether the at least one area fill feature will be printed with a combination of different black inks and is likely to produce a visible image defect if printed in an N-pass bidirectional print mode, where N is an integer;

printing non-fill regions of the image data using the N-pass bidirectional print mode; and automatically switching to an M-pass bidirectional print mode for printing the at least one area fill feature when it is determined that the at least one area fill feature will be printed with a combination of different black inks and is likely to produce a visible image defect, where M is an integer greater than N.

2. The method of claim 1, wherein N is one and M is two.

3. The method of claim 1, wherein the at least one area fill feature represents a plurality of contiguous pixels that all have a common gray scale value.

4. The method of claim 1, and further comprising:

automatically switching back to the N-pass bidirectional print mode after printing the at least one area fill feature.

5. The method of claim 1, wherein the fluid-ejection printing device is an inkjet printing device.

6. The method of claim 1, wherein the fluid-ejection printing device is a monochrome inkjet printing device that is configured to exclusively print with black inks.

7. A fluid-ejection printing device, comprising:

a fluid-ejection printing mechanism configured to eject droplets of fluid on media in correspondence with image data;

a data processing mechanism configured to identify at least one area fill feature of the image data that will be printed with a combination of different black inks and that is likely to produce a visible image defect if printed in a one-pass bidirectional print mode; and wherein the fluid-ejection printing mechanism is configured to print non-fill regions of the image data using the one-pass bidirectional print mode, and is configured to automatically switch to a multi-pass bidirectional print mode for printing the at least one area fill feature.

8. The fluid-ejection printing device of claim 7, wherein the at least one area fill feature represents a plurality of contiguous pixels that all have a common gray scale value.

9. The fluid-ejection printing device of claim 7, wherein the fluid-ejection printing mechanism is configured to automatically switch back to the one-pass bidirectional print mode after printing the at least one area fill feature.

10. A printing system, comprising:

a fluid-ejection printing mechanism configured to eject droplets of fluid on media in correspondence with image data;

a controller configured to identify at least one area fill feature of the image data that will be printed with a combination of different black inks and that is likely to produce a visible image defect if printed in a one-pass bidirectional print mode; and wherein the controller is configured to cause the fluid-ejection printing mechanism to print non-fill regions of the image data using the one-pass bidirectional print mode and automatically switch to a multi-pass bidirectional print mode for printing the identified at least one area fill feature.

11. A method of printing a document using a fluid-ejection printing device, the method comprising:

receiving gray scale image data for the document;

identifying at least one area fill feature of the image data;

determining whether the at least one area fill feature will be printed with a combination of different black inks and is likely to produce a visible image defect if printed in an N-pass bidirectional print mode, where N is an integer;

printing non-fill regions of the image data using the N-pass bidirectional print mode; and automatically switching to an M-pass bidirectional print mode for printing the at least one area fill feature when it is determined that the at least one area fill feature will be printed with a combination of different black inks and is likely to produce a visible image defect, where M is an integer greater than N;

wherein the determining whether the at least one area fill feature will be printed with a combination of different black inks and is likely to produce a visible image defect if printed in the N-pass bidirectional print mode comprises:

identifying whether an ink density of the at least one area fill feature is greater than a minimum threshold density at which gray scale shift banding becomes visible to the human eye.

12. The method of claim 11, wherein the minimum threshold density is about 70%.

13. The method of claim 11, wherein the minimum threshold density is about 85%.

14. The method of claim 11, wherein the determining whether the at least one area fill feature will be printed with a combination of different black inks and is likely to produce a visible image defect if printed in the N-pass bidirectional print mode comprises:

identifying whether the ink density of the at least one area fill feature is less than a maximum threshold density at which only a single black ink is used to print the at least one area fill feature.

15. The method of claim 14, wherein the maximum threshold density is about 99%.

16. A fluid-ejection printing device, comprising:

a fluid-ejection printing mechanism configured to eject droplets of fluid on media in correspondence with image data;

a data processing mechanism configured to identify at least one area fill feature of the image data that will be printed with a combination of different black inks and that is likely to produce a visible image defect if printed in a one-pass bidirectional print mode; and wherein the fluid-ejection printing mechanism is configured to print non-fill regions of the image data using the one-pass bidirectional print mode, and is configured to automatically switch to a multi-pass bidirectional print mode for printing the at least one area fill feature; and wherein the data processing unit is configured to identify whether an ink density of the at least one area fill feature is greater than a minimum threshold density at which gray scale shift banding becomes visible to the human eye.

17. The fluid-ejection printing device of claim 16, wherein the minimum threshold density is about 70%.

18. The fluid-ejection printing device of claim 16, wherein the minimum threshold density is about 85%.

19. The fluid-ejection printing device of claim 16, wherein the data processing unit is configured to identify whether the ink density of the at least one area fill feature is less than a maximum threshold density at which only a single black ink is used to print the at least one area fill feature.

20. The fluid-ejection printing device of claim 19, wherein the maximum threshold density is about 99%.

* * * * *